US005343445A

United States Patent [19]

Cherdak

[11] Patent Number: 5,343,445

[45] Date of Patent: Aug. 30, 1994

[54] ATHLETIC SHOE WITH TIMING DEVICE

[75] Inventor: Erik B. Cherdak, Silver Spring, Md.

[73] Assignees: David Stern; James Thompson, both of Rockville, Md.

[21] Appl. No.: 85,936

[22] Filed: Jul. 6, 1993

[51] Int. Cl.[5] ..... G04B 47/00; A43B 3/00; G04F 8/00

[52] U.S. Cl. ..... 368/10; 368/110; 36/132; 36/137

[58] Field of Search ..... 368/10, 9, 107–113; 36/132, 136, 137, 114

[56] References Cited

U.S. PATENT DOCUMENTS

| | | | |
|---|---|---|---|
| D. 285,142 | 8/1986 | McArthur . | |
| 4,285,041 | 8/1981 | Smith . | |
| 4,309,599 | 1/1982 | Myers . | |
| 4,371,945 | 2/1983 | Karr et al. . | |
| 4,402,147 | 9/1983 | Wu . | |
| 4,466,204 | 8/1984 | Wu . | |
| 4,510,704 | 4/1985 | Johnson . | |
| 4,578,769 | 3/1986 | Frederick . | |
| 4,649,552 | 3/1987 | Yukawa . | |
| 4,651,446 | 3/1987 | Yukawa et al. . | |
| 4,703,445 | 10/1987 | Dassler . | |
| 4,736,312 | 4/1988 | Dassler et al. . | |
| 4,763,287 | 8/1988 | Gerhaeuser et al. . | |
| 4,771,394 | 9/1988 | Cavanagh . | |
| 4,792,665 | 12/1988 | Ruhlemann . | |
| 4,814,661 | 3/1989 | Ratzlaff et al. | 310/328 |
| 4,848,009 | 7/1989 | Rodgers | 36/137 |
| 4,876,500 | 10/1989 | Wu . | |
| 4,891,797 | 1/1990 | Woodfalks | 368/10 |
| 4,956,628 | 9/1990 | Furlong . | |
| 5,033,013 | 7/1991 | Kato . | |
| 5,052,131 | 10/1991 | Benbiri | 36/137 |
| 5,125,647 | 6/1992 | Smith . | |

FOREIGN PATENT DOCUMENTS

WO8804768 6/1988 World Int. Prop. O. .

*Primary Examiner*—Vit W. Miska

[57] ABSTRACT

An athletic shoe which includes a timing device for measuring the amount of time the athletic shoe is off the ground and in air. The athletic shoe can also include a notification device which can be operatively coupled to the timing device for notifying a wearer of the athletic shoe of a message. The message can include information related to the amount of time the athletic shoe is off the ground and in the air.

23 Claims, 3 Drawing Sheets

ATHLETIC SHOE WITH TIMING DEVICE

BACKGROUND OF THE INVENTION

1. Technical Field

The present invention relates to athletic shoes.

2. Background Information

It is well known that basketball, volleyball, and other sports activities players often try to stay in the air for relatively long periods of time while they attempt to perform a particular action. For example, basketball players often attempt to stay or "hang" in the air for as long as possible as they try to slam-dunk a basketball into a basketball net. The amount of time a basketball player hangs in the air is commonly referred to as his or her "hang time." Hang time has become so popular that basketball players often compete with each other as to who can hang in the air the longest (i.e. the player with the longest "hang time" wins). Moreover, many great professional basketball players have become quite popular for their "hang times" (e.g. Michael Jordan of the Chicago BULLS).

While hang time has become a popular measure of a player's abilities, there has not heretofore been proposed an accurate and objective way to calculate the amount of time a player remains in the air while performing a sport related activity. Moreover, there has not heretofore been proposed a way or a device which can be used to calculate a player's hang time and which may be manufactured, marketed, and sold in consumer-appealing ways at effective price points.

The present invention solves these problems.

SUMMARY OF THE INVENTION

It is an object of the present invention to solve the above-listed problems.

It is another object of the present invention to provide wearers of athletic shoes with the ability to keep track of the amount of time they spend in the air and off the ground when participating in an athletic activity such as basketball for example.

These and other objects of the present invention are achieved in an athletic shoe which includes an athletic shoe configuration and a timing device for measuring the amount of time the athletic shoe is off the ground and in the air.

Finally, the present invention provides for a timing device which is integrated into an athletic shoe which has a messaging device such as a visual display.

As already stated, and as stated throughout the remaining sections of this patent document, the terminology "off the ground and in the air" is used to define and describe the structure and operation of the present invention. Moreover, the word "ground" is meant to include the ground, the surface of a basketball court, the floor, and any other surface on which a sports related activity takes place.

BRIEF DESCRIPTION OF THE DRAWINGS

The present invention is described by way of example and in regard to the drawing Figures in which.

The following section will refer to the above-listed drawing Figures. Where appropriate, like structures will be referenced with like numerals.

DETAILED DESCRIPTION OF THE PREFERRED EMBODIMENT

Figure 1:
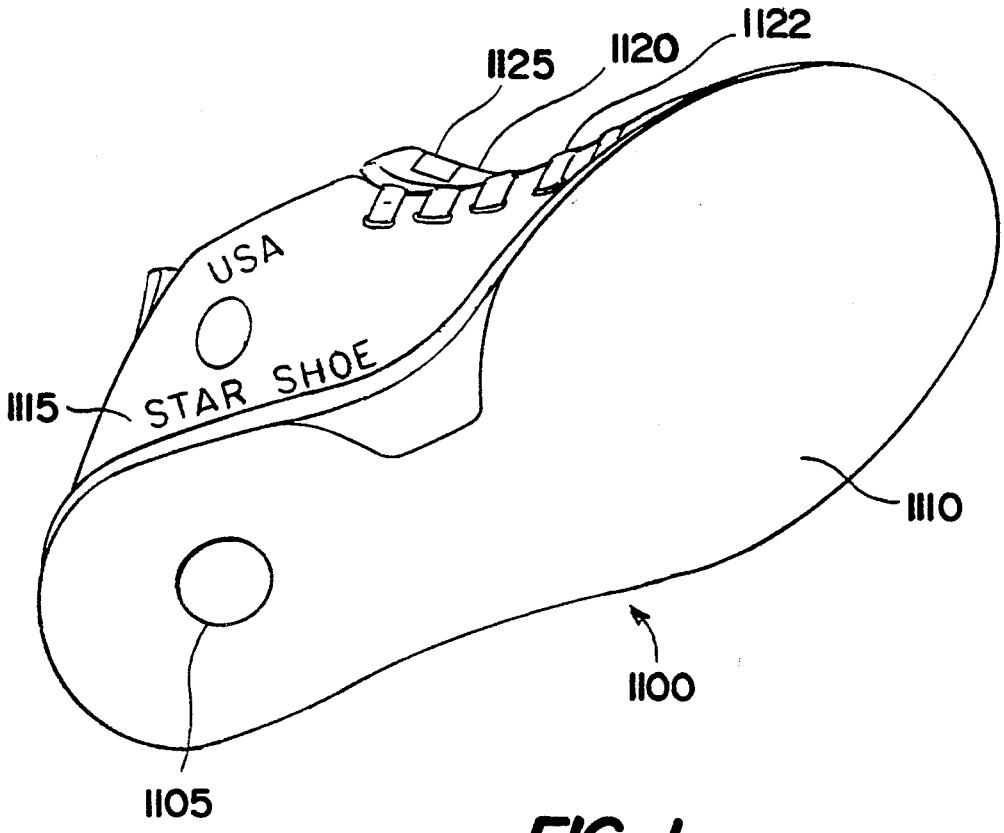
FIG. 1 is a diagram of an athletic shoe which is equipped with a timing device.

The present invention is described by way of example and in regard to the drawing Figures which were briefly described above and which are discussed in detail below.

Referring now to FIG. 1, therein depicted is an athletic shoe 1100 which has been equipped with a timing device. Athletic shoe 1100 is a basketball type shoe similar to those manufactured by LA GEAR, REEBOK, NIKE, BRITISH KNIGHTS, CONVERSE, and NEW BALANCE. Athletic shoe 1100 has a rubber type sole 1110 in which a contact dimple 1105 has been formed during manufacture. Contact dimple 1105 can be similar to that implemented in LA GEAR's LA TECH LIGHT GEAR shoes. Shoe upper 1115 is mounted to rubber sole 1110 in a conventional manner and will be apparent to those skilled in the art of athletic shoe construction. Tongue 1120 is also mounted to shoe upper 1115 in a conventional manner and is held against a wearer's foot (not shown) by fastening arrangement 1122 in the usual way. While tongue 1120 is shown as an actual tongue 1120 in the conventional sense, other structures such as now-popular sock-type vamp members may be used. Such sock-type vamp members will be apparent to those skilled in the art and may be seen in such shoes as those manufactured by NIKE (i.e. the AIR HURACHE line of cross-training shoes). While laces are shown as providing fastening arrangement 1122, other fastening arrangements such as hook and loop, straps, and button fasteners may be used as such fasteners will be apparent to those skilled in the art.

Tongue 1120 includes a message device 1125. A message is meant to include a visual and/or audible notification which is meant to notify a wearer of athletic shoe 1100 of at least one particular piece of information such as, for example, the amount of time athletic shoe 1100 is off the ground and in the air and time of day, and alphanumeric textual and/or verbal expressions. In this embodiment, message device 1125 is a visual display in the form of a liquid crystal display which will be apparent to those skilled in the art. Flexible visual displays can also be used as can light emitting diode (LED) arrangements. While message device 1125 is a visual display, other messaging type devices such as buzzers and noise makers, flashing bulbs and the like may also be used. Also, voice provision devices may also be used to provide messages to the wearer of athletic shoe 1100. Such structures will be apparent to those skilled in the art. Moreover, message device 1125 can include combinations of both visual and audible devices. Such audible devices can include piezo-electric buzzers, speakers, bells, and the like which will be apparent to those skilled in the art. Finally, while message device is shown as part of tongue 1120, other parts of athletic shoe 1100 could also house the such a display. For example, message device 1125 could also be located on the back of athletic shoe 1100, on the sides of athletic shoe 1100, on the toe portion of athletic shoe 1100, or any other place on athletic shoe 1100 which is practically possible and is commercially advantageous.

Figure 2:
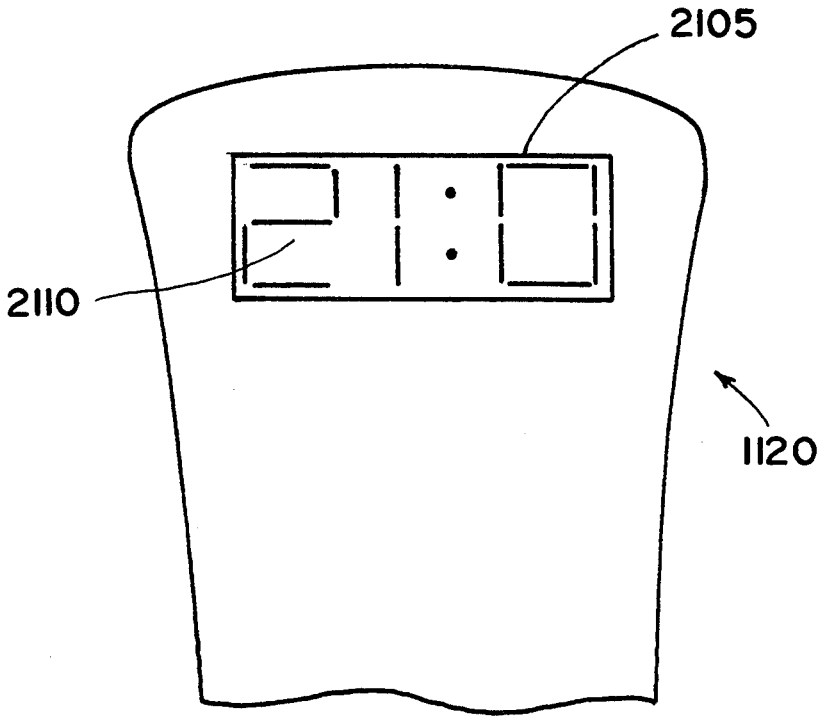
FIG. 2 is a front view of a tongue of an athletic shoe which has been equipped with a visual display.
Figure 3:
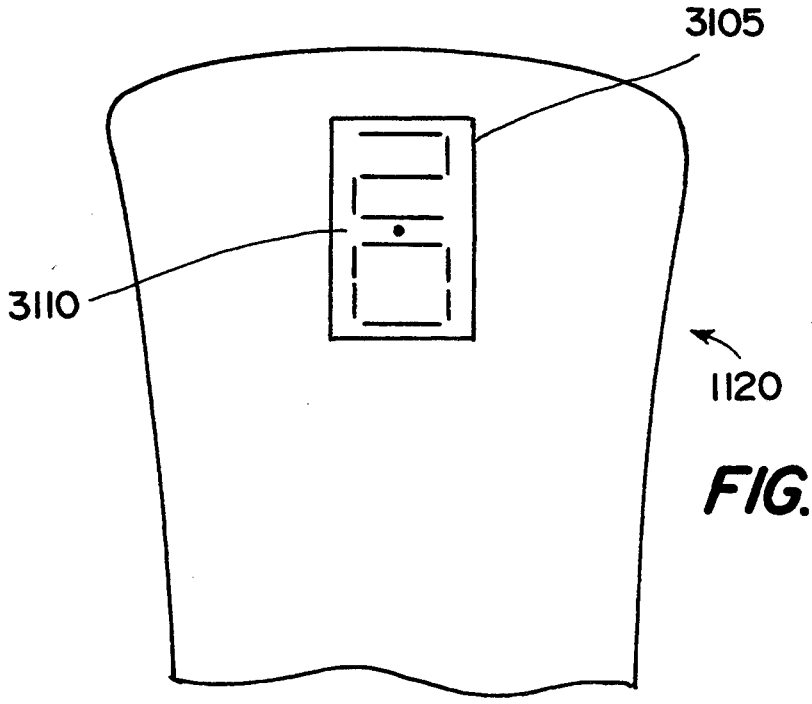
FIG. 3 is a front view of a tonue of an athletic shoe with has been equipped with a visual display.

Referring now to FIGS. 2 and 3, therein depicted are different preferred embodiments of tongue 1120. As shown in FIG. 2, tongue 1120 includes a horizontally readable message device 1125 in the form of a visual display 2105 of the liquid crystal display (LCD) variety. The numbers 2110 displayed on visual display 2105 are shown upside down so that a wearer of an athletic shoe which is equipped with tongue 1120 will be able to read the display merely by looking down at his shoes. Three numeric positions are shown on visual display 2105 to display seconds, tenths of seconds, and hundredths of seconds. Timing device 4110 will be configured to provide the aforementioned timing accuracy. While three numeric characters are shown as displayed on visual display 2105, more than three or less than three may be displayed depending on the design requirements chosen and the selected timing accuracy desired. Moreover, while only numeric characters are shown on visual display 2105, other characters such as alpha and graphic characters could also be displayed on visual display 2105. The display of alpha, numeric, and graphic characters on visual display 2105 will be apparent to those skilled in the art.

Numbers 2110 are shown as displayed on visual display 2105 in normal video but may configured to appear in "reverse video" fashion (i.e. unlit digits against a dark background—no illumination against an illuminated background). While visual display 2105 is ergonomically placed on the front of tongue 1120 (i.e. the side that faces away from a wearer's foot), it is quite possible to select a visual display which may be mounted on the top part of tongue 1120 or on the back of tongue 1120 (i.e. on the side that faces the wearer's foot). It is believed that tongue 1120 presents the best place for mounting visual display 2105 since wiring will be least complicated and so that the ergonomics of reading visual display 2105 are maximized.

In FIG. 3, message device 1125 is in the form of a visual display 3105 of the liquid crystal display (LCD) variety. In contrast to visual display 2105, visual display 3105 is oriented in a vertical fashion. Visual display 3105 is shown as displaying only two numbers which represent seconds and tenths of seconds. It should be understood that the message length may be longer than the physical dimension of the display and may therefore be scrolled in a conventional manner. The vertical nature of Visual display 3105 allows messages to be read in a vertical fashion.

Figure 4:
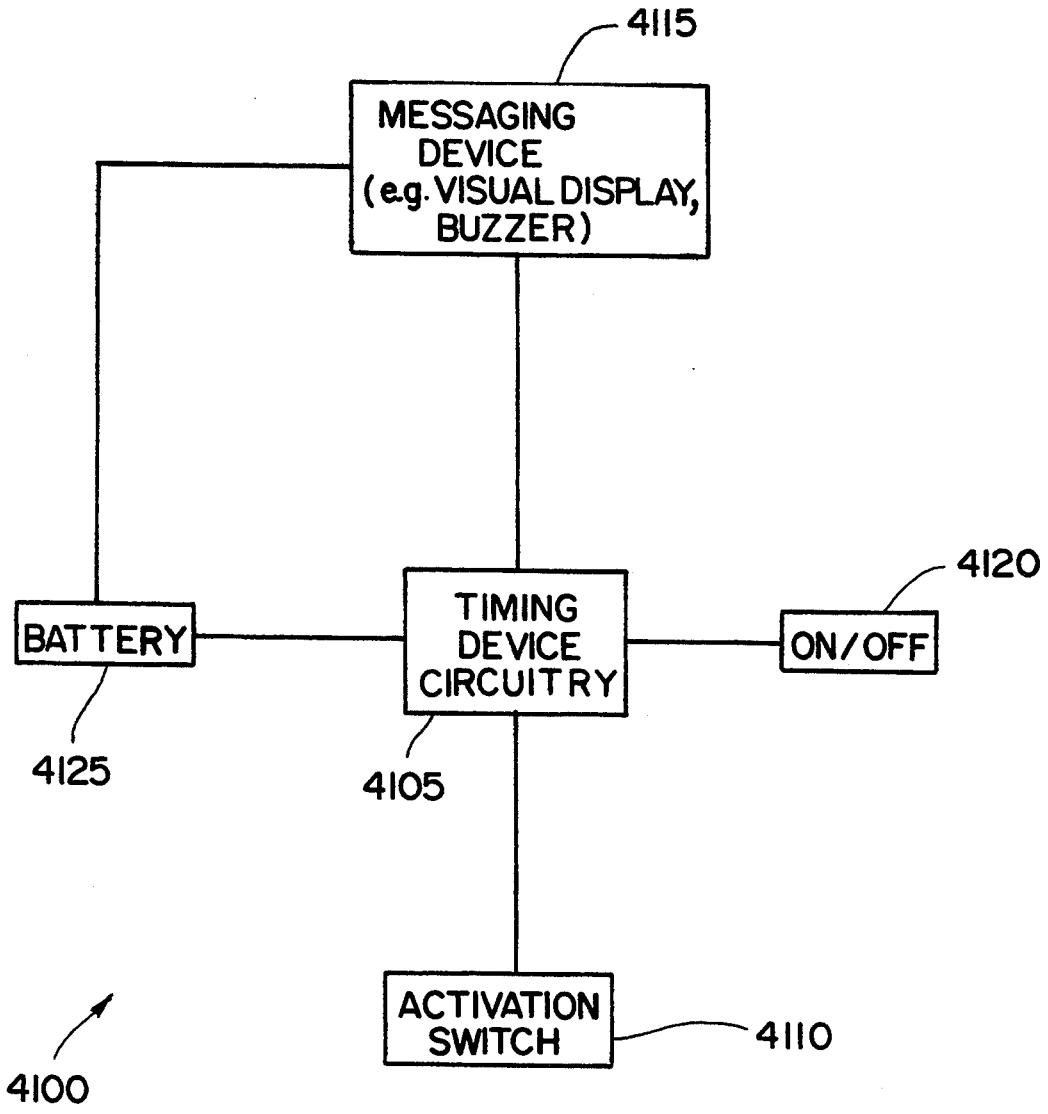
FIG. 4 is block schematic diagram of an exemplary embodiment of the present invention.

Referring now to FIG. 4, therein depicted is a block schematic diagram of an exemplary embodiment of the present invention and which is of the type used in athletic shoe 1100 as shown in FIG. 1. Timing system 4100 includes timing device circuitry 4105, an activation switch 4110, a messaging device 4115, a battery 4125, and a system ON/OFF switch 4120.

Timing device circuitry 4105 is connected to battery 4125, messaging device 4115, system ON/OFF switch 4120, and activation switch 4110. Timing device circuitry 4105 preferably includes readily available and well known clocking circuits which may be found in consumer electronics goods such as digital stop watches, digital timers, digital wristwatches, digital cooking timers, and digital thermometers which include timers used to measure the amount of time needed to calculate a person's body temperature. While dedicated timing devices and circuits may be used, other custom logic devices which include microprocessors and/or microcomputers may also be used. For example, a microprocessor (e.g. a 4 BIT or 8 BIT microprocessor) may be configured with the necessary support circuitry (e.g. ROM, RAM, etc.) and programmed via software to achieve timer and timing operation. Such use of a microprocessor to achieve timer and timing operation will be apparent to those skilled in the art. Additionally, the use of microprocessors and associated support circuitry to achieve timer and timing functionality can result in providing designers with the ability to provide more elaborate messages beyond those which merely a time value. That is, messages may be formed by timing device circuitry which provide motivational sayings which are dependant on the amount of time a person's shoe is off the ground and in the air (e.g. "novice," "HANGER," "ACE," "NUMBER '1,' "POOR," "OK," "GOOD," "AVERAGE," or "GREAT!") In the event that messages are desired which include strings of characters which are longer than a display width, such messages may be scrolled in a conventional manner.

Timing device circuitry 4105 preferably must be able to calculate and measure a period of time with accuracy of at least tenths of a second. That is, timing device circuitry 4105 should be able to calculate and measure the passage of time in units as small as tenths of seconds, but preferably would be able to calculate and measure time in units as small as hundredths of a second.

Connected to timing device circuitry 4105 is messaging device 4115. The connection of timing device circuitry 4105 to messaging device 4115 is done in a conventional way (e.g. much like the connection of an LCD display to the calculation circuitry of a hand-held calculator or to the stop-watch timing circuitry of a digital wristwatch). Messaging device 4115 is preferably a visual display of the liquid crystal display (LCD) variety (e.g. wristwatch LCDs, hand-held calculator LCDs, illuminated LCDs found on wristwatches and portable cellular telephones), but may also include light emitting diode (LED) arrangements. Such LCD and LED displays will be apparent to those skilled in the art. As mentioned above, messages may include alpha, numeric, and graphic characters and may be smaller than, equal to, and larger than the physical display size of massaging device 4115. In the case where messages are larger than the display size of massaging device 4115, such messages may be scrolled in the conventional manner.

Messaging device 4115 preferably is able to display a message which can include a time value (e.g. 1:50 seconds) but may also be configured to display a message formed from alpha characters, numeric characters, graphic characters, or any combination thereof. Preferably, messaging device 4115 will be able to display seconds measured, tenths of seconds measured, and hundredths of seconds measured by timing device circuitry 4105. Messaging device can be configured to display a constant running time (e.g. like a wristwatch stop-watch display) or can only display time after activation switch 4110 has been triggered.

While a visual display such as an LCD display is preferred, other messaging devices such as buzzers, speakers, bells, speech devices, and combinations thereof may also be used to provide a message to the wearer of an athletic shoe which is equipped with such a messaging system.

As mentioned above, connected to timing device circuitry 4105 is activation switch 4110. Activation switch 4110 is preferably similar in construction to LA GEAR, INC.'s LIGHT GEAR system (LA TECH) wherein a battery is maintained in a custom designed plastic switch carrier. The sole of a shoe in which LA GEAR's switch carrier resides is formed with a contact dimple which, when pressed upon contact of the shoe sole with the ground, causes the switch carrier to become compressed to thereby cause the battery to come in operative contact with the leads of a single light emitting diode (LED). While activation switch 4110 is preferably like that of the LA GEAR design other switching systems including contact switches, tape switches, pressure switches, and any other well known switching system would also work in the present invention.

Timing system ON/OFF switch 4120 is a conventional on-off switch and is used to turn timing system 4100 on and off so as to conserve battery life during periods of non-use. The connection of timing system ON/OFF switch 4120 will be apparent to those of ordinary skill in the art.

Power is supplied to timing system 4100 via battery 4125. Preferably, battery 4125 is of similar specification to that of the battery used by LA GEAR, INC. in its LA TECH line of athletic shoes. The connection of battery 4125 to the other components of timing system 4100 will be apparent to those of ordinary skill in the art.

Timing system 4100 is preferably mounted in an athletic shoe similar to the one depicted in FIG. 1 in the following ways: Timing device circuitry 4105 is preferably mounted in the tongue of the athletic shoe as is system ON/OFF switch 4120. Messaging device 4115 is preferably mounted on the front of the tongue of the athletic shoe so that a wearer may read the display easily. Activation switch 4110 is preferably mounted along with battery 4125 in a switch pack which is housed in the heel of the athletic shoe (e.g. as in LA GEAR INC.'s LIGHT GEAR—LA TECH design). While these configuration specifications are preferred, other arrangements may be maintained so as to effectuate particular design requirements.

In use, timing system 4100 is placed into operation by placing system ON/OFF switch 4120 into an "ON" state. When system ON/OFF switch 4120 is placed into an "ON" state an audible tone may be sounded if timing system 4100 is equipped with an audible sounding device. Such "beeping" during initialization will be apparent to those skilled in the art. Moreover, if timing system 4100 is equipped with a proper circuitry, a message can appear on display which indicates such things as "ON" state, shoe manufacturer and various other indicia.

Next, timing device circuitry 4105 should be initialized (i.e. clock circuits reset and zeroed). Preferably, timing device circuitry will begin to measure a time period whenever the shoe in which the system resides is off the ground and in the air. While such operation may seem cumbersome, messaging device will only be able to display and/or sound a message after timing device circuitry 4105 has measured a threshold time period. In this manner, times will not be displayed each time a person walks, but only after a person performs a jump or other action in which he or she is in the air and off the ground for an extended period of time (e.g. during a slam-dunking action while playing basketball).

The threshold time period just mentioned is the amount of time an average person takes to make one step during a walking regimen. That is, the threshold time period was analyzed to be in the range of at least 0.2 seconds to about 0.55 seconds. Only after timing device circuitry measures a period of time equal to some threshold amount should timing device circuitry 4105 allow messaging device 4115 display a time based message. More specifically, only after timing device circuitry 4105 has measured a period of time of say at least 0.3 seconds will messaging device 4115 be given a message to display and/or sound. While the threshold time was determined to be between 0.2 and 0.55 seconds on average across a sampling of people and trials, the present invention should not be so limited. Moreover, the threshold time may change depending on what activity is chosen to provide the benchmark for determining an average threshold time (e.g. walking was the chosen benchmark activity whereas running, skipping, and skating could also have been used). The threshold time feature will allow timing system 4100 to display and/or sound time-based messages only when a person performs a "hang" type activity for period of time beyond a threshold period. It is important to note that timing system 4100 could also be configured to provide structure which will allow user selection and/or input of a given time period to effectuate more personal and accurate threshold time period benchmarks.

The threshold time feature solves the "reset" problem (i.e. the problem of knowing when to start and stop measuring a time period). The reset problem is solved in that the timing system 4100 will always measure the amount of time an athletic shoe is off the ground and in the air, but will only cause the display or sounding a time-based message when the amount of time measured by timing device circuitry is beyond a certain threshold.

A period of time is measured, as suggested above, by the action of bringing the shoe off the ground and then returning the shoe to the ground (i.e. causing activation switch to trip). In this manner a time period is measured when a shoe equipped with timing system 4100 is off the ground and in the air.

Timing system may also be equipped with a "lock-in" switch which can be configured to hold a present value on the display so that no other timing messages may be displayed until the lock-in switch is disengaged. Conventional latching of massaging device 4115 can be used to achieve this functionality.

While the above structures and operation were discussed with reference to the embodiments shown in the drawings, other features can be incorporated into the present invention. Such features do not present difficult design problems and will be apparent to those skilled in the art. For example, the present invention utilizes a single shoe system. A two-shoe timing system may be configured which incorporates radio-frequency and/or infra-red technology between shoes so as to allow the measurement of time only when both shoes are off the ground and in the air. Such RF and IR technology will be apparent to those skilled in the art.

Also, a shoe can be configured which incorporates an RF transmitter which transmits to a central location so that a player's "hang-time" (i.e. his time of the ground and in the air) can be displayed on a score board at publicly viewed games. In this fashion, "hang-time" can become a carefully measured and followed statistic whereas presently it is only speculated. Such RF technology and scoreboard technology will be apparent to those skilled in the art.

Finally, while timing information was primarily the driving force behind the present invention other information may be determined, sensed, and/or measured. Such other information, which can be displayed and/or sounded in the form of a message, can include, but is not limited to, speed, distance traveled, alpha-numeric messages, elevation, activity time or duration, stride length, cadence, foot pressure, acceleration, and various other activity information. The technology necessary to provide these pieces of information will be apparent to those skilled in the art. The present invention now makes possible the provision of such information in easy, marketable, and cost effective manners.

Having now fully described the present invention, it will be apparent to one of ordinary skill in the art that many changes and modifications can be made thereto without departing from the spirit and scope of the present invention as defined by the appended claims.

I claim:

1. A method for indicating hang time off the ground and in the air during a jump by a person wearing an athletic shoe, said method comprising the steps:

(a) sensing, within said shoe, when said shoe leaves the ground during said jump;

(b) sensing, within said shoe, when said shoe returns to the ground at the end of said jump; and (c) activating a hang time indicator on said shoe during the time interval between said shoe leaving and returning to the ground as sensed in steps (a) and (b), respectively, said indicator providing an indication of hang time in a manner perceptible to said person.

2. The method of claim 1 wherein step (c) comprises illuminating a light emitting device on said shoe throughout said time interval.

3. The method of claim 1 wherein step (c) comprises flashing a plurality of flashing lights on said shoe throughout said time interval.

4. The method of claim 1 wherein step (c) comprises providing an audible sound from said shoe.

5. The method of claim 4 wherein the audible sound provided in step (c) is an enunciation of elapsed time of said time interval.

6. The method of claim 1 wherein step (c) comprises providing a visibly readable message on said shoe of elapsed time in said time interval.

7. The method of claim 6 further comprising the step of inhibiting said visibly readable message during walking and running steps by said person.

8. The method of claim 7 wherein said step of inhibiting comprises inhibiting said visibly readable message unless said elapsed time exceeds a predetermined minimum time.

9. The method of claim 8 wherein said predetermined minimum time is at least 0.2 seconds.

10. A method for measuring and indicating hang time off the ground and in the air during a jump by a person wearing an athletic shoe, said method comprising the steps of:

(a) measuring in the shoe elapsed time between the shoe leaving the ground and returning to the ground;

(b) from the elapsed time measured in step (a), determining in said shoe whether said person has jumped off the ground or taken a walking or running step; and (c) upon determining in step (b) that the person has jumped off the ground, providing an indication at said shoe, perceptible to said person, of the elapsed time measured in step (a).

11. The method of claim 10 wherein step (b) comprises determining that said person has jumped off the ground when the measured elapsed time is at least 0.2 seconds.

12. The method of claim 10 wherein step (c) comprises providing a visibly readable indication on said shoe of the measured elapsed time.

13. An athletic shoe comprising:

a sole;

a shoe upper mounted on said sole;

pressure responsive means mounted on said shoe for providing a signal in said shoe in response to said shoe leaving the ground when on the foot of a person, and for removing said signal in response to said shoe returning to the ground;

a timer in said shoe actuable in response to said signal for measuring elapsed time; and an elapsed time display at said shoe for providing a visible reading of the elapsed time measured by said timer.

14. The athletic shoe of claim 13 further comprising:

means in said shoe for inhibiting said visible reading unless the elapsed time measured by said timer exceeds a predetermined time corresponding to the time a shoe is normally off the ground during running and walking steps.

15. The athletic shoe of claim 14 wherein said predetermined time is at least 0.2 seconds.

16. The athletic shoe of claim 13 wherein said elapsed time display is a liquid crystal numerical display.

17. The athletic shoe of claim 13 further comprising a tongue secured to said upper, and wherein said elapsed time display is mounted on said tongue.

18. The athletic shoe of claim 17 wherein said means is a switch mounted in said sole and actuable in response to compressive force urging said sole against the ground.

19. An athletic shoe comprising:

a sole;

a shoe upper mounted on said sole;

pressure responsive means on said shoe for providing a signal in response to said shoe leaving the ground when on the foot of an individual, and for removing said signal in response to said shoe returning to the ground;

circuit means in said shoe actuable in response to said signal; and indicator means at said shoe responsive to actuation of said circuit means for providing a perceptible indication related to the time said shoe is off the ground.

20. The athletic shoe of claim 19 wherein said indicator means comprises at least one device responsive to actuation of said circuit means for emitting light while said shoe is off the ground.

21. The athletic shoe of claim 19 wherein said indicator means comprises a device responsive to actuation of said circuit means for providing an audible signal while said shoe is off the ground.

22. In an athletic shoe having an upper member secured to a sole member, the sole member having a heel portion with a cavity in which circuitry is housed, apparatus for indicating the time that the athletic shoe is off the ground and in the air during a jump by a person wearing the athletic shoe, said apparatus comprising:

a pressure responsive switch producing a signal when said athletic shoe is off the ground and in the air, said switch being disposed in the sole member of said athletic shoe;

a plurality of light emitting diodes (LEDs) disposed on the athletic shoe, said plurality of light emitting diodes (LEDs) emitting light during the period of time when the athletic shoe is off the ground and in the air during said jump to provide a visual indication of the amount of time that the athletic shoe is off the ground and in the air;

a controller disposed in the sole member of the athletic shoe and connected to said switch and to said plurality of light emitting diodes (LEDs), wherein said controller is responsive to said signal to cause said plurality of light emitting diodes (LEDs) to emit said light during said period of time that said athletic shoe is off the ground and in the air; and a power source connected to said switch, to said plurality of light emitting diodes (LEDs) and to said controller, said power source disposed in the sole member of said athletic shoe.

23. The apparatus of claim 22 wherein said switch, said plurality of LEDs, said controller and said power source are disposed in the heel portion of the sole member of said athletic shoe.

* * * * *

US005343445C1

(12) EX PARTE REEXAMINATION CERTIFICATE (6136th)

United States Patent
Cherdak

(10) Number: US 5,343,445 C1
(45) Certificate Issued: Mar. 4, 2008

(54) ATHLETIC SHOE WITH TIMING DEVICE

(75) Inventor: Erik B. Cherdak, 149 Thurgood St., Gaithersburg, MD (US) 20878

(73) Assignee: Erik B. Cherdak, Gaithersburg, MD (US)

Reexamination Request:
No. 90/008,269, Oct. 2, 2006

Reexamination Certificate for:

| | |
|---|---|
| Patent No.: | **5,343,445** |
| Issued: | **Aug. 30, 1994** |
| Appl. No.: | **08/085,936** |
| Filed: | **Jul. 6, 1993** |

(51) Int. Cl.
*G04B 47/00* (2006.01)
*A43B 3/00* (2006.01)

(52) U.S. Cl. ..... 368/10; 368/110; 36/132; 36/137

(58) Field of Classification Search ..... None
See application file for complete search history.

(56) References Cited

U.S. PATENT DOCUMENTS 5,285,586 A * 2/1994 Goldston et al. ..... 36/137
5,303,485 A 4/1994 Goldston et al.
5,452,269 A * 9/1995 Cherdak ..... 368/10

OTHER PUBLICATIONS

Internet Document: Charlie's Sneaker Pages, Illuminated Sneakers (You Light Up My Sneakers), Sep. 17, 2007, http://sneakers.pair.com/lightup.htm (4 pages).
Correspondence from LA Gear (Christopher M. Walsh to James L. Thompson dated Nov. 16, 1993 regarding technology of U.S. Patent Nos. 5,343,445 & 5,452,269—Cherdak Inventor (2 pages).
Internet Document: Apple, Inc. Website, Nike+ iPod Sport Kit, Sep. 28, 2007, http://store.apple.com/1–800–MY–APPLE/WebObjects/AppleStore?spart=MA365LL%2FB.

* cited by examiner

*Primary Examiner*—James Menefee

(57) ABSTRACT

An athletic shoe which includes a timing device for measuring the amount of time the athletic shoe is off the ground and in air. The athletic shoe can also include a notification device which can be operatively coupled to the timing device for notifying a wearer of the athletic shoe of a message. The message can include information related to the amount of time the athletic shoe is off the ground and in the air.

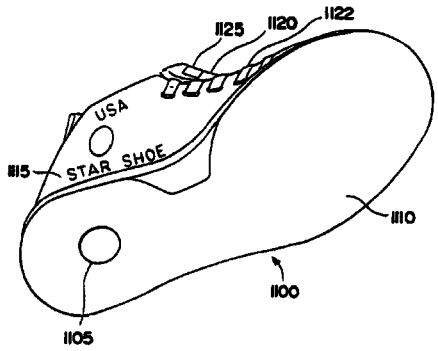

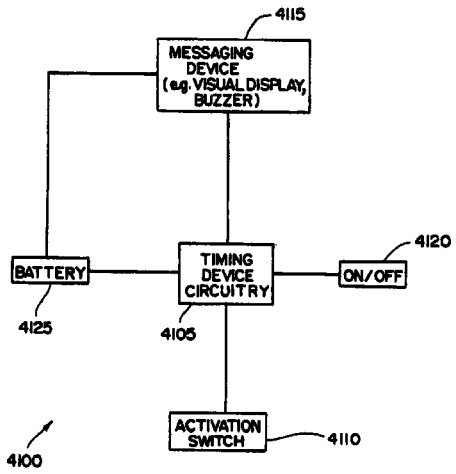

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 22–23 is confirmed.

Claims 1 and 19 are determined to be patentable as amended.

Claims 2–3 and 20, dependent on an amended claim, are determined to be patentable.

Claims 4–18 and 21 were not reexamined.

1. A method for indicating hang time off the ground and in the air during a jump by a person wearing an athletic shoe, said method comprising the steps:

(a) sensing, within said shoe, [when said] *pressure imparted to said shoe when said* shoe leaves the ground during said jump;

(b) sensing, within said shoe, [when said] *pressure imparted to said shoe when said* shoe returns to the ground at the end of said jump; and (c) activating a hang time indicator on said shoe during the time interval between said shoe leaving and returning to the ground as sensed in steps (a) and (b), respectively, said indicator providing an indication of hang time in a manner perceptible to said person.

19. An athletic shoe comprising:

a sole;

a shoe upper mounted on said sole;

pressure responsive means [on said shoe] *for responding to pressure imparted to said shoe during a jump,* for providing a signal in response to said shoe leaving the ground [when on the foot of an individual] *at the beginning of said jump*, and for removing said signal in response to said shoe returning to the ground *at the end of said jump*;

circuit means in said shoe actuable in response to said signal; and indicator means at said shoe responsive to actuation of said circuit means for providing a perceptible indication related to the time said shoe is off the ground.

* * * * *

US005343445C2

(12) EX PARTE REEXAMINATION CERTIFICATE (9397th)

United States Patent
Cherdak

(10) Number: US 5,343,445 C2
(45) Certificate Issued: Nov. 5, 2012

(54) ATHLETIC SHOE WITH TIMING DEVICE

(75) Inventor: Erik B. Cherdak, Silver Spring, MD (US)

(73) Assignee: Erik B. Cherdak, Gaithersburg, MD (US)

Reexamination Request:
No. 90/012,249, Apr. 27, 2012

Reexamination Certificate for:

| | |
|---|---|
| Patent No.: | **5,343,445** |
| Issued: | **Aug. 30, 1994** |
| Appl. No.: | **08/085,936** |
| Filed: | **Jul. 6, 1993** |

Reexamination Certificate C1 5,343,445 issued Mar. 4, 2008

(51) Int. Cl.
*G04B 47/00* (2006.01)
*A43B 3/00* (2006.01)

(52) U.S. Cl. ..... 368/10; 368/110; 36/132; 36/137
(58) Field of Classification Search ..... None
See application file for complete search history.

(56) References Cited

To view the complete listing of prior art documents cited during the proceeding for Reexamination Control Number 90/012,249, please refer to the USPTO's public Patent Application Information Retrieval (PAIR) system under the Display References tab.

*Primary Examiner* — Minh T Nguyen

(57) ABSTRACT

An athletic shoe which includes a timing device for measuring the amount of time the athletic shoe is off the ground and in air. The athletic shoe can also include a notification device which can be operatively coupled to the timing device for notifying a wearer of the athletic shoe of a message. The message can include information related to the amount of time the athletic shoe is off the ground and in the air.

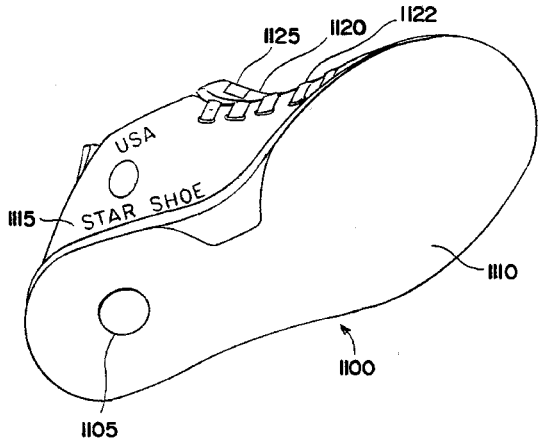

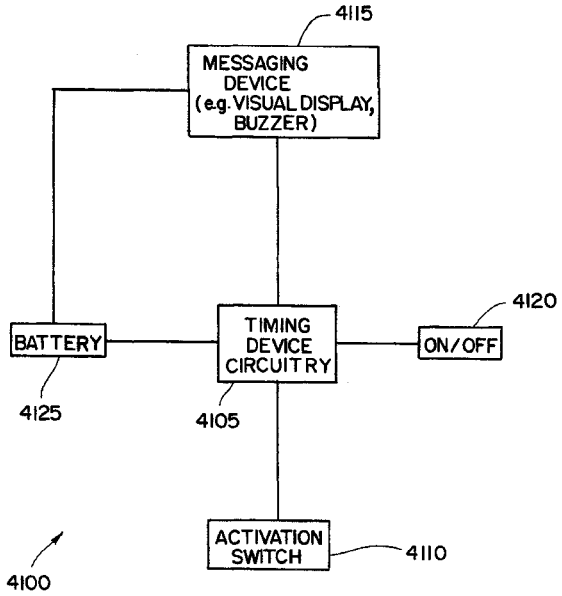

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1-23 is confirmed.

New claims 24-29 are added and determined to be patentable.

*24. An athletic shoe, comprising:*

*an upper member;*

*a sole mounted together with said upper member, said sole configured to receive a sensor for providing a first signaling characteristic in response to said athletic shoe leaving the ground when on the foot of a person, and for providing a second signaling characteristic in response to said athletic shoe returning to the ground;*

*a processor configured to determine elapsed time between said athletic shoe leaving and returning to the ground based on said first and second signaling characteristics, respectively; and*

*a transmitter configured to transmit a signal related to said elapsed time to an indicator located remotely from said athletic shoe, said indicator configured to provide an indication related to said elapsed time.*

*25. A method for indicating time off the ground and in the air during an activity including a jump, a walking step, a running step., or a skating lift by a person wearing an athletic shoe suitable to said activity, said method comprising the steps of:*

*(a) sensing, within said shoe, pressure imparted to said shoe when said shoe leaves the ground during said activity;*

*(b) sensing, within said shoe, pressure imparted to said shoe when said shoe returns to the ground at the end of said activity; and*

*(c) activating, within said shoe, a messaging device in relation to the time interval between said shoe leaving and returning to the ground as sensed in steps (a) and (b)., respectively, said messaging device proving an indication related to said time interval in a manner perceptible to said person.*

*26. The method according to claim 25. wherein said messaging device activated during said activating step (c) is located at said shoe.*

*27. The method according to claim 25. wherein said messaging device activated during said activating step (c) is located remotely from said shoe.*

*28. The method according to claim 25, wherein said messaging device activated during said activating step (c) is worn on said person and remotely from said shoe.*

*29. The method according to claim 25, wherein said activating step involves transmitting a signal to a receiver coupled to said messaging device to cause said messaging device to provide a message related to said activity to said person.*

* * * * *